US007004259B2

(12) United States Patent
Pietras

(10) Patent No.: US 7,004,259 B2
(45) Date of Patent: Feb. 28, 2006

(54) APPARATUS AND METHOD FOR FACILITATING THE CONNECTION OF TUBULARS USING A TOP DRIVE

(75) Inventor: Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/621,971

(22) Filed: Jul. 17, 2003

(65) Prior Publication Data

US 2004/0011531 A1 Jan. 22, 2004

Related U.S. Application Data

(63) Continuation of application No. 09/868,438, filed as application No. PCT/GB99/03944 on Nov. 29, 1999, now Pat. No. 6,622,796.

(30) Foreign Application Priority Data

Dec. 24, 1998 (GB) ..... 9828669

(51) Int. Cl.
*E21B 19/00* (2006.01)

(52) U.S. Cl. ..... 166/379; 166/85.1; 166/77.51; 175/170

(58) Field of Classification Search ..... 166/379, 166/378, 380, 85.11, 117.5, 206, 77.51, 162, 166/338, 341, 77.53, 85.1; 175/170, 162, 175/113, 423, 52
See application file for complete search history.

(56) References Cited

U.S. PATENT DOCUMENTS

| | | | | |
|---|---|---|---|---|
| 1,917,135 A | | 7/1933 | Littell | |
| 3,041,901 A | | 7/1962 | Knights | 81/53 |
| 3,193,116 A | | 7/1965 | Kenneday et al. | 214/2.5 |
| 3,380,528 A | | 4/1968 | Timmons | 166/14 |
| 3,548,936 A | | 12/1970 | Kilgore et al. | |
| 3,552,507 A | | 1/1971 | Brown | |
| 3,566,505 A | | 3/1971 | Martin | 29/200 |
| 3,570,598 A | | 3/1971 | Johnson | 166/178 |
| 3,635,105 A | | 1/1972 | Dickmann et al. | 81/57.18 |
| 3,680,412 A | * | 8/1972 | Mayer et al. | 81/57.34 |
| 3,691,825 A | | 9/1972 | Dyer | 73/136 |
| 3,747,675 A | | 7/1973 | Brown | 166/237 |
| 3,776,320 A | | 12/1973 | Brown | 173/163 |
| 3,776,991 A | | 12/1973 | Marcus | 264/89 |
| 3,848,684 A | | 11/1974 | West | 175/195 |
| 3,857,450 A | | 12/1974 | Guier | 175/85 |
| 3,913,687 A | | 10/1975 | Gyongyosi et al. | 175/85 |
| 4,100,968 A | | 7/1978 | Delano | 166/315 |
| 4,320,915 A | | 3/1982 | Abbott et al. | 294/96 |

(Continued)

FOREIGN PATENT DOCUMENTS

EP 01 62000 A1 11/1985

(Continued)

OTHER PUBLICATIONS

LaFleur Petroleum Services, Inc., "Autoseal Circulating Head," Engineering Manufacturing, 1992, 11 Pages.

(Continued)

*Primary Examiner*—Frank S. Tsay
(74) *Attorney, Agent, or Firm*—Moser, Patterson & Sheridan, LLP

(57) ABSTRACT

An apparatus for facilitating the connection of tubulars using a top drive, the apparatus comprising a supporting member (13) connectable to said top drive (3) characterized in that it further comprises an internal tool (30) for engaging said tubular (7) and an external clamping device (39) for engaging said tubular (7).

38 Claims, 3 Drawing Sheets

U.S. PATENT DOCUMENTS 4,437,363 A 3/1984 Haynes ..... 81/57.18
4,449,596 A 5/1984 Boyadjieff ..... 175/85
4,494,424 A 1/1985 Bates ..... 81/57.18
4,529,045 A 7/1985 Boyadjieff et al. ..... 173/164
4,570,706 A 2/1986 Pugnet ..... 166/77.5
4,593,773 A 6/1986 Skeie ..... 175/85
4,604,724 A 8/1986 Shaginian et al. ..... 364/478
4,605,077 A 8/1986 Boyadjieff ..... 175/85
4,625,796 A 12/1986 Boyadjieff ..... 166/77.5
4,646,827 A 3/1987 Cobb
4,649,777 A 3/1987 Buck ..... 81/57.19
4,667,752 A * 5/1987 Berry et al. ..... 175/85
4,676,312 A 6/1987 Mosing et al. ..... 166/77
4,683,962 A 8/1987 True ..... 173/163
4,709,599 A 12/1987 Buck ..... 81/57.18
4,709,766 A 12/1987 Boyadjieff
4,742,876 A 5/1988 Barthelemy et al. ..... 175/7
4,759,239 A 7/1988 Hamilton et al. ..... 81/57.34
4,762,187 A 8/1988 Haney ..... 175/171
4,765,401 A 8/1988 Boyadjieff ..... 166/77.53
4,773,689 A 9/1988 Wolters ..... 294/88
4,781,359 A 11/1988 Matus
4,791,997 A 12/1988 Krasnov ..... 175/57
4,793,422 A 12/1988 Krasnov ..... 175/57
4,800,968 A 1/1989 Shaw et al. ..... 175/85
4,813,493 A 3/1989 Shaw et al. ..... 173/164
4,821,814 A * 4/1989 Willis et al. ..... 173/164
4,832,552 A 5/1989 Skelly
4,836,064 A 6/1989 Slator ..... 81/57.18
4,867,236 A 9/1989 Haney et al. ..... 166/77.5
4,878,546 A 11/1989 Shaw et al. ..... 173/163
4,936,382 A 6/1990 Thomas
4,962,819 A 10/1990 Bailey et al.
4,997,042 A 3/1991 Jordan et al. ..... 166/379
5,009,265 A 4/1991 Bailey et al. ..... 166/118
5,036,927 A 8/1991 Willis ..... 175/162
RE34,063 E 9/1992 Vincent et al.
5,191,939 A 3/1993 Stokley ..... 166/379
5,251,709 A 10/1993 Richardson ..... 175/220
5,255,751 A 10/1993 Stogner ..... 175/203
5,297,833 A 3/1994 Willis et al. ..... 294/102.2
5,305,839 A 4/1994 Kalsi et al.
5,332,043 A 7/1994 Ferguson
5,351,767 A 10/1994 Stogner et al. ..... 175/162
5,388,651 A 2/1995 Berry ..... 175/85
5,433,279 A 7/1995 Tessari et al. ..... 173/213
5,501,286 A 3/1996 Berry ..... 175/52
5,503,234 A 4/1996 Clanton ..... 175/52
5,553,672 A 9/1996 Smith, Jr. et al. ..... 166/382
5,575,344 A 11/1996 Wireman
5,577,566 A 11/1996 Albright et al. ..... 175/321
5,584,343 A 12/1996 Coone ..... 166/387
5,645,131 A 7/1997 Trevisani ..... 175/171
5,706,894 A 1/1998 Hawkins, III
5,735,348 A 4/1998 Hawkins, III ..... 166/285
5,785,132 A 7/1998 Richardson et al.
5,791,410 A 8/1998 Castille et al. ..... 166/77.1
5,803,191 A 9/1998 Mackintosh ..... 175/170
5,836,395 A 11/1998 Budde ..... 166/321
5,839,330 A 11/1998 Stokka
5,850,877 A 12/1998 Albright et al.
5,909,768 A 6/1999 Castille et al. ..... 166/77.1
5,971,079 A 10/1999 Mullins ..... 166/387
5,971,086 A 10/1999 Bee et al.
5,988,273 A 11/1999 Monjure et al.
6,000,472 A 12/1999 Albright et al. ..... 166/380
6,056,060 A 5/2000 Abrahamsen et al. ..... 166/380
6,070,500 A 6/2000 Dlask et al. ..... 81/57.33
6,142,545 A 11/2000 Penman et al.
6,161,617 A 12/2000 Gjedebo
6,173,777 B1 1/2001 Mullins
6,199,641 B1 3/2001 Downie et al. ..... 175/55
6,217,258 B1 4/2001 Yamamoto et al.
6,227,587 B1 5/2001 Terral
6,237,684 B1 5/2001 Bouligny, Jr. et al.
6,309,002 B1 10/2001 Bouligny ..... 294/86.25
6,311,792 B1 11/2001 Scott et al. ..... 175/162
6,315,051 B1 11/2001 Ayling
6,349,764 B1 2/2002 Adams et al. ..... 166/77.53
6,360,633 B1 3/2002 Pietras ..... 81/57.34
6,412,554 B1 7/2002 Allen et al. ..... 166/80.1
6,431,626 B1 8/2002 Bouligny ..... 294/86.25
6,443,241 B1 9/2002 Juhasz et al.
6,527,047 B1 3/2003 Pietras
6,536,520 B1 * 3/2003 Snider et al. ..... 166/78.1
6,622,796 B1 9/2003 Pietras
6,651,737 B1 11/2003 Bouligny
6,668,684 B1 * 12/2003 Allen et al. ..... 81/57.15
6,688,394 B1 * 2/2004 Ayling ..... 166/380
6,691,801 B1 * 2/2004 Juhasz et al. ..... 175/27
6,725,938 B1 4/2004 Pietras
6,742,596 B1 6/2004 Haugen
2001/0042625 A1 11/2001 Appleton ..... 166/379
2002/0134555 A1 9/2002 Allen et al. ..... 166/377
2004/0000405 A1 1/2004 Fournier, Jr. et al.
2004/0003490 A1 1/2004 Shahin et al.
2004/0069500 A1 4/2004 Haugen
2004/0079533 A1 4/2004 Bautaert et al.
2004/0173358 A1 9/2004 Haugen
2004/0216924 A1 11/2004 Pietras et al.
2004/0251050 A1 12/2004 Shahin et al.
2004/0262013 A1 12/2004 Tilton et al.
2005/0000691 A1 1/2005 Giroux et al.

FOREIGN PATENT DOCUMENTS

EP 0 171 144 A1 2/1986
EP 0 285 386 A2 10/1988
EP 0 479 583 4/1992
EP 0 525 247 A1 2/1993
EP 0 589 823 A1 3/1994
EP 0 659 975 6/1995
EP 1 148 206 10/2001
EP 1 256 691 11/2002
GB 2 224 481 A 9/1990
GB 2 275 486 A 4/1993
GB 2 357 530 A 6/2001
WO WO 93/07358 4/1993
WO WO 96/18799 6/1996
WO WO 98/05844 2/1998
WO WO 98/11322 3/1998
WO WO 98/32948 7/1998
WO WO 99/41485 8/1999
WO WO 00/05483 2/2000
WO WO 00/05483 3/2000
WO WO 00/11309 3/2000
WO WO 00/11310 3/2000
WO WO 00/11311 3/2000
WO WO 00/13310 3/2000
WO WO 00/39429 7/2000
WO WO 00/39430 7/2000
WO WO 03/087525 10/2003

OTHER PUBLICATIONS

Valves Wellhead Equipment Safety Systems, W-K-M Division, ACF Industries, Catalog 80, 1980, 5 Pages.
"Canrig Top Drive Drilling Systems," Harts Petroleum Engineer International, Feb. 1997, 2 Pages.
"The Original Portable Top Drive Drilling System," TESCO Drilling Technology, 1997.
Killalea, Mike, "Portable Top Drives: What's Driving The Market?" IADC, Drilling Contract, Sep. 1994, 4 Pages.
"500 or 650 ECIS Top Drive," Advanced permanent Magnet Motor Technology, TESCO Drilling Technology, Apr. 1998 , 2 Pages.
"500 of 650 HCIS Top Drive," Powerful Hydraulic Compact Top Drive Drilling System, TESCO Drilling Technology, Apr. 1998, 2 Pages.
"Product Information (Sections 1-10), " CANRIG Drilling Technology, Ltd. Sep. 18, 1996.
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Laurent, et al., "Hydraulic Rig Supports Casing Drilling, " World Oil, Sep. 1999, pp. 61-68.
Shepard, et al., "Casing Drilling: An Emerging Technology," IAD/SPE Paper 67731, SPE/IADC Drilling Conference, Feb. 27-Mar. 1, 2001, pp. 1-13.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
Tessari, et al., "Retrievable Tools Provide Flexibility for Casing Drilling," Paper No. WOCD-0306-01, World Oil Casing Drilling Technical Conference, 2003, pp. 1-11.
Tommy Warren, SPE, Bruce Houtchens, SPE, Garret Madell, SPE, Directional Drilling With Casing, SPE/IADC 79914, Tesco Corporation, SPE/IADC Drilling Conference 2003.

* cited by examiner

APPARATUS AND METHOD FOR FACILITATING THE CONNECTION OF TUBULARS USING A TOP DRIVE

CROSS-REFERENCE TO RELATED APPLICATIONS

This application is a continuation of U.S. patent application Ser. No. 09/868,438, filed Sep. 4, 2001, now U.S. Pat. No. 6,622,796, which is the National Stage of International Application No. PCT/GB99/03944, filed Nov. 29, 1999 and published under PCT Article 21(2) in English, and claims priority of United Kingdom Application No. 9828669.3, filed on Dec. 24, 1998. Each of the aforementioned related patent applications is herein incorporated by reference.

BACKGROUND OF THE INVENTION

1. Field of the Invention

This invention relates to an apparatus and method for facilitating the connection of tubulars using a top drive and is, more particularly but not exclusively, intended for facilitating the connection of a section or stand of casing to a string of casing.

2. Description of the Related Art

In the construction of oil or gas wells it is usually necessary to line the borehole with a string of tubulars known as casing. Because of the length of the casing required, sections or stands of say two or three sections of casing are progressively added to the string as it is lowered into the well from a drilling platform. In particular, when it is desired to add a section or stand of casing the string is usually restrained from falling into the well by applying the slips of a spider located in the floor of the drilling platform. The new section or stand of casing is then moved from a rack to the well centre above the spider. The threaded pin of the section or stand of casing to be connected is then located over the threaded box of the casing in the well and the connection is made up by rotation therebetween. An elevator is then connected to the top of the new section or stand and the whole casing string lifted slightly to enable the slips of the spider to be released. The whole casing string is then lowered until the top of the section is adjacent the spider whereupon the slips of the spider are re-applied, the elevator disconnected and the process repeated.

It is common practice to use a power tong to torque the connection up to a predetermined torque in order to make the connection. The power tong is located on the platform, either on rails, or hung from a derrick on a chain. However, it has recently been proposed to use a top drive for making such connection.

Because of the high costs associated with the construction of oil and gas wells time is critical and it has been observed by the applicants that the time to connect a tubular to a top drive using existing equipment could be reduced.

There is described an apparatus for facilitating the connection of tubulars using a top drive in co-pending UK Patent Application No. 9818358.5, which apparatus comprises a body connectable to a top drive, the body comprising at least one gripping element radially displaceable by hydraulic or pneumatic fluid to drivingly engage the tubular. Preferably, the gripping elements are moveable radially outwardly to engage the inside wall of the tubular.

WO98/11322 describes a device for connecting casings and which comprises a tool for gripping a pipe internally. The tool is connected to a top drive so that the tool and the pipe can be rotated.

It has been observed that torques of up to 95,000 Nm (70,000 lbs/ft) are required to make-up a joint.

It has also been observed that the apparatus of the present invention may be used for facilitating rotation of the casing while running the casing down a wellbore.

It has also been observed that a drill bit may be placed on the bottom end of the casing string and used for boring a wellbore. The apparatus of the present invention may be used for facilitating rotation of the casing for boring a wellbore.

SUMMARY OF THE INVENTION

According to a first aspect of the invention there is provided an apparatus for facilitating the connection of tubulars using a top drive, the apparatus comprising a supporting member (13) connectable to said top drive (3), an internal clamping tool (30) for engaging said tubular (7) and an external clamping device (39) for engaging said tubular (7) wherein said internal clamping tool (30) and said external clamping device (39) are moveable with respect to each other, characterised in that said internal clamping tool (30) comprises gripping elements (34) suitable for transferring a first torque to said tubular (7) and said external clamping device (39) comprises gripping elements (44) suitable for transferring a second torque to said tubular (7).

Other features of the first aspect of the present invention are set out in claims 2 to 11. In particular, said apparatus may comprises a flexible membrane arranged between said internal clamping tool (30) and said external clamping device (39), said flexible membrane containing a fluid.

There is also provided a method for facilitating the connection of tubulars using a top drive, the method comprising the steps of inserting and activating an internal tool for engaging said tubular; rotating said tool and tubular to a low torque, activating an external clamping device for engaging said tubular and rotating said clamping device and said tubular to a high torque.

According to a second aspect of the invention there is provided a method for facilitating the connection of tubulars, using a top drive, the method comprising the steps of inserting and activating an internal clamping tool to engage a first tubular, rotating said tool and first tubular to threadedly engage said first tubular with a second tubular at a first torque, activating an external clamping device for engaging said first tubular and rotating said clamping device and said tubular to tighten said connection to a second torque.

Preferably, the first torque is sufficient to run a pin on said first tubular into a box and the second tubular is sufficient to tighten said connection to its designated value.

According to a third aspect of the invention there is provided an apparatus for facilitating the connection of tubulars, the apparatus comprising a tool for gripping a tubular and at least one piston and cylinder for raising and lowering said tool characterized in that, in use, torque applied to the supporting member is transformed to said tool through said at least one piston and cylinder. Preferably, three piston and cylinders are provided.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

For a better understanding of the present invention, reference will now be made, by way of example, to the accompanying drawings, in which.

DETAILED DESCRIPTION OF THE PREFERRED EMBODIMENT

Figure 1:
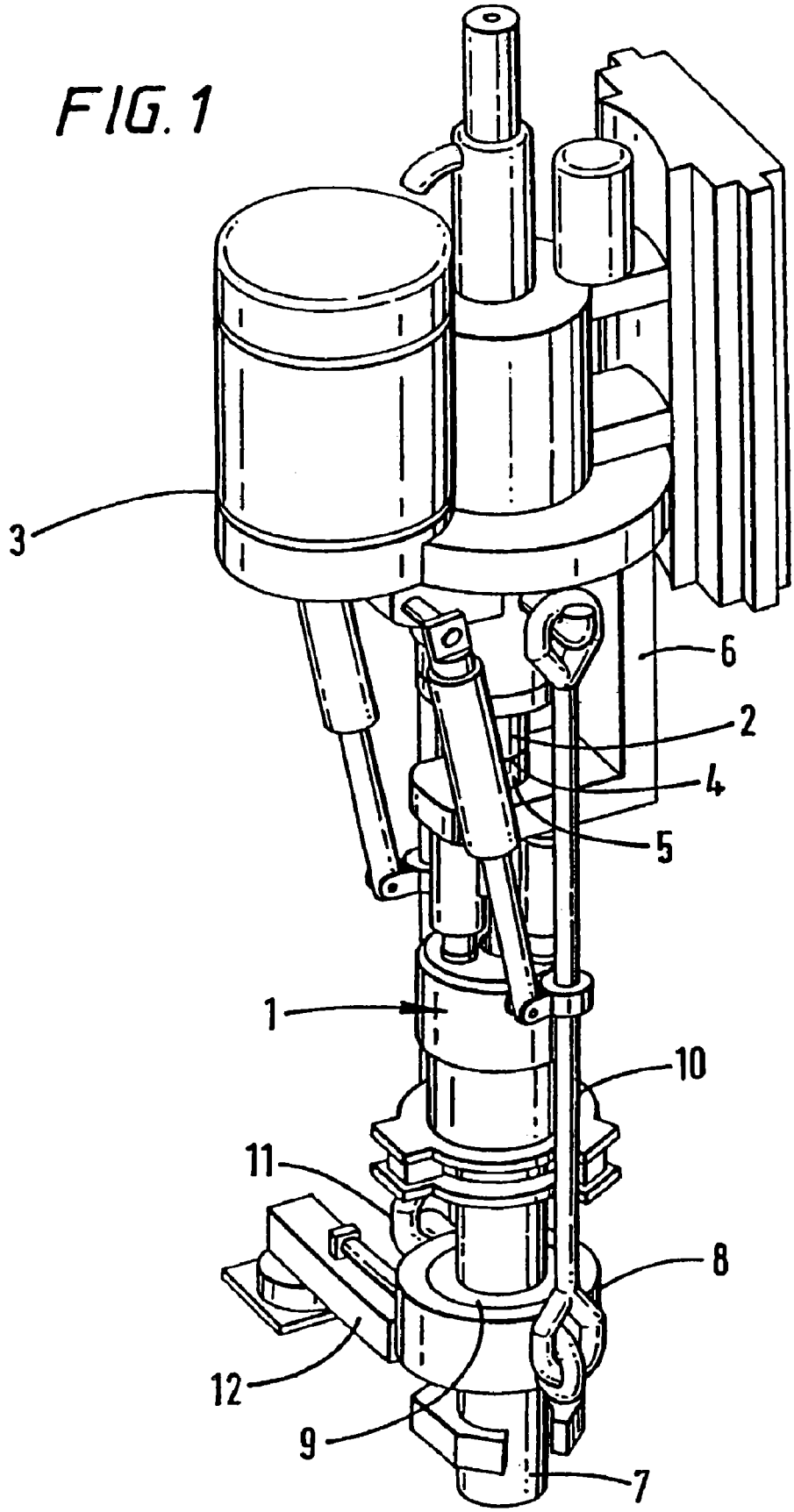
FIG. 1 is a view in perspective of an apparatus according to the invention, the apparatus being shown in use.
Figure 2:
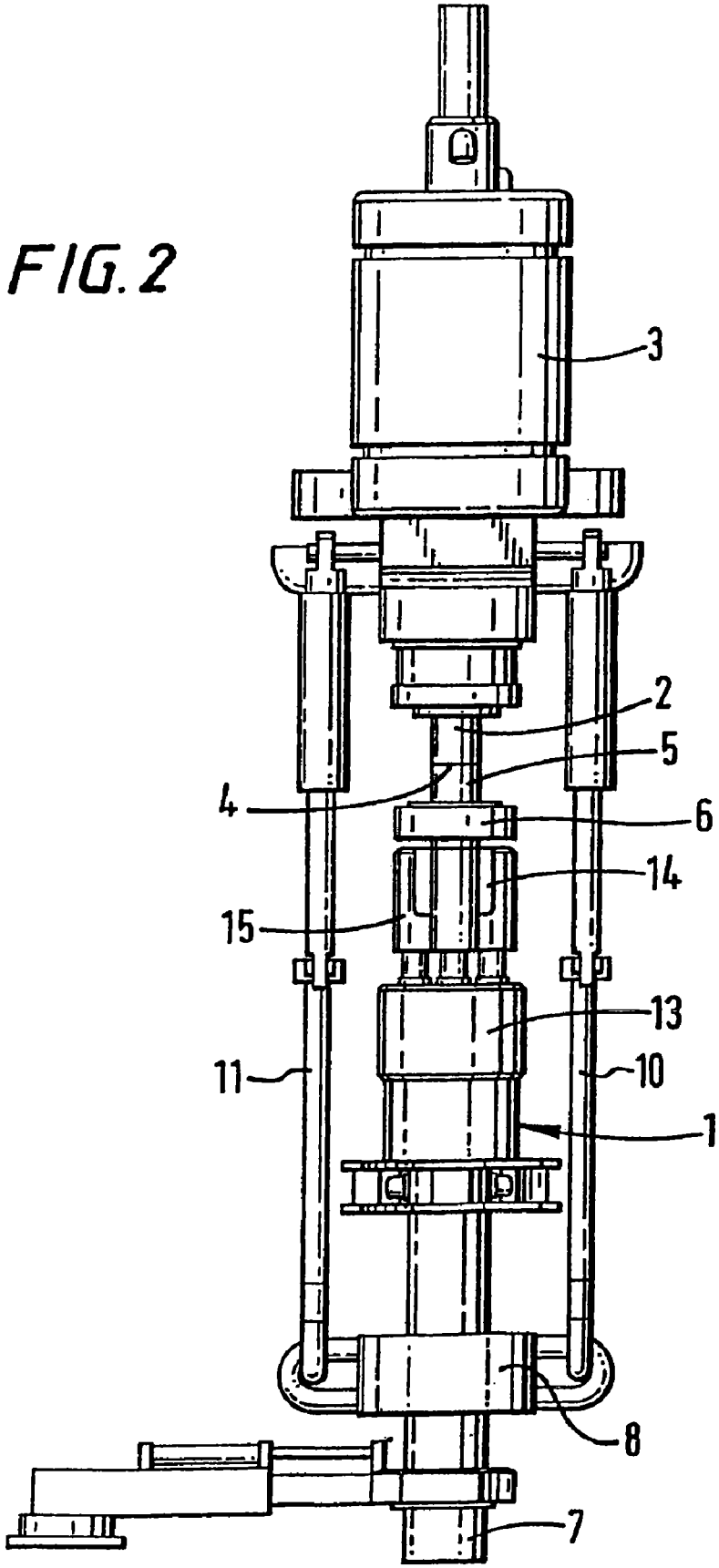
FIG. 2 is a front plan view of the apparatus of FIG. 1, the apparatus being shown in use.
Figure 3:
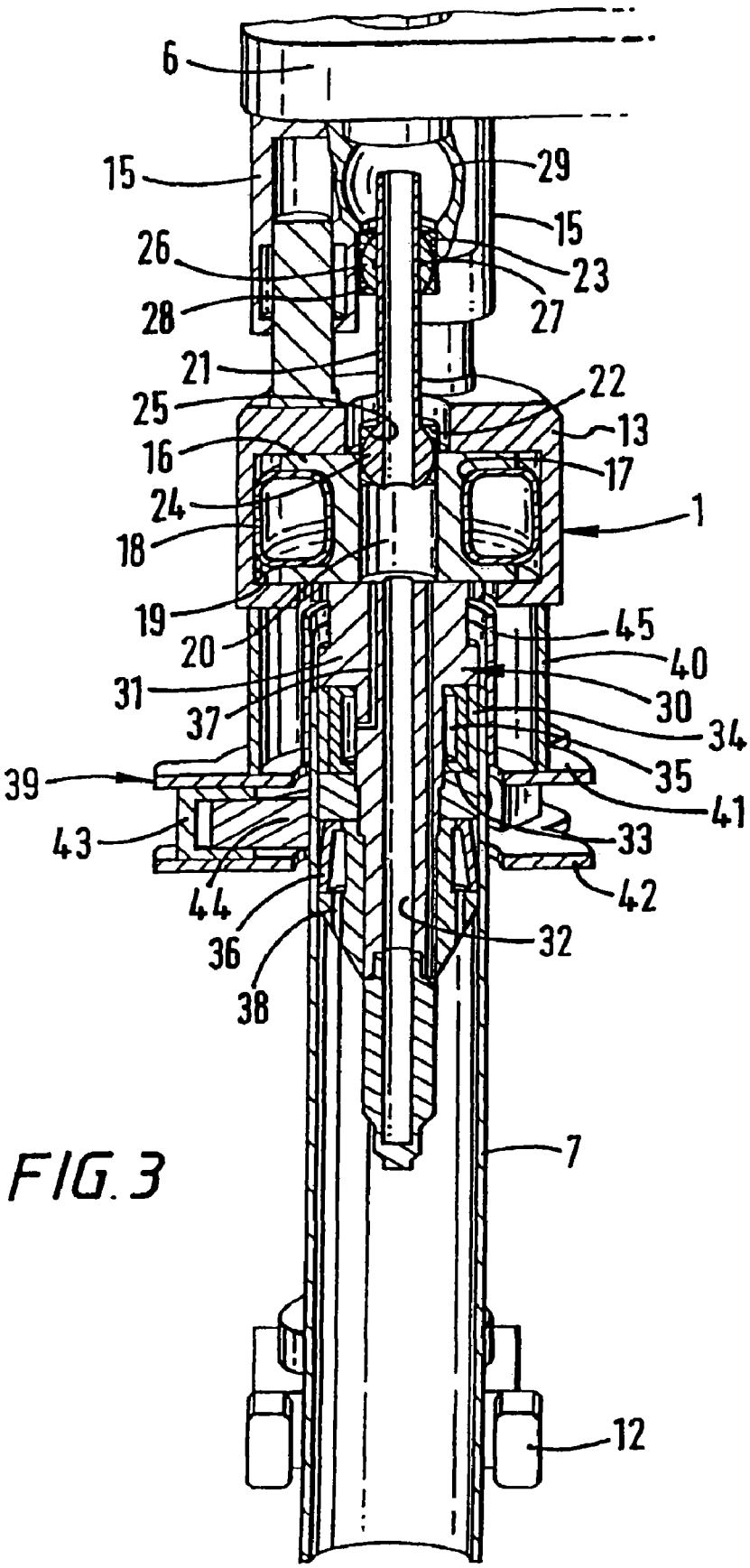
FIG. 3 is an enlarged cross-sectional view of parts of FIG. 1.

Referring to the drawings, there is shown an apparatus for facilitating the connection of tubulars using a top drive. The apparatus is generally identified by reference numeral 1.

The apparatus 1 is shown connected to a rotor 2 of a top drive 3 via connection 4 to a rotor 5 of the apparatus 1. The top drive 3 is located on rails on a derrick of a rig (not shown). A rigid member 6 is fast with a static part of the top drive 3. The rigid member surrounds the rotor 5. The rigid member 6 has a clamp therein which, when required, applies jaws (not shown) to the rotor 5 such that, upon rotation of the rotor 2 of the top drive 3, the apparatus 1 may be connected or disconnected from the top drive 3. When the jaws are released, the rotor 5 may rotate freely within the rigid member 6.

The apparatus 1 is shown with a stand of casing 7 inserted therein. An elevator 8 is shown gripping the stand of casing 7 with the use of gripping elements 9. The elevator 8 is suspended from the top drive 3 on bails 10 and 11. The stand of casing 7 is guided by a pipe handling arm 12.

The apparatus 1 comprises a housing 13 which depends from the rotor 5 via a supporting element 14 and three piston and cylinders 15. The three piston and cylinders 15 allow small vertical movements of the apparatus 1 relative to the top drive 3. The three piston and cylinders 15 may be hydraulically activated or pneumatically activated or using a combination of both pneumatic and hydraulic fluids.

The housing 13 accommodates a hub 16 which is radially and rotationally moveable therein. The hub 16 has a circumferential recess 17 into which an inflatable ring 18 is arranged. The inflatable ring 18 is in frictional engagement with both the hub 16 and an internal wall 19 of the housing 13. The hub 16 has a central bore 20 into which one end of a mud pipe 21 is inserted. The mud pipe 21 is provided for carrying mud to the inside of the tubular 7. The mud pipe 21 is mounted in cylindrical sections 22 and 23 which are attached to the hub 16 and the supporting element 14 respectively. The mud pipe 21 is provided with a lobe 24 formed on the outer surface thereof and is located in a corresponding recess 25 in the cylindrical section 22. A lobe 26 is slidably arranged on the upper end of the mud pipe 21 with an O-ring seal 27 arranged therebetween to inhibit fluid from leaking therebetween. The lobe 26 is located in a corresponding recess 28 in the cylindrical section 23. This arrangement allows a ball and socket type movement between the supporting element 14 and the hub 16 and relative longitudinal movement therebetween. The upper end of the mud pipe 21 is allowed to move freely in a spherical recess 29 in the supporting element 14.

A circulating tool generally identified by reference numeral 30 is fixed to and depends from the hub 16. The circulating tool 30 comprises a cylindrical body 31 which has a central passage 32 therethrough. The cylindrical body 31 has a plurality of recesses 33 thereabout in which gripping elements 34 are located. The gripping elements are provided with recesses 35.

The cylindrical body 31 is also provided with an inflatable sealing ring 36 arranged below the gripping elements 34.

The cylindrical body 31 is provided with a feed passage 37 the upper end of which is connected to a hydraulic fluid supply and at the other end to the recesses 35 in the gripping elements 34. A feed passage 38 connects the inflatable sealing ring 36 with the inside of the tubular 7.

A clamping device 39 depends from the housing 13 on a rigid cylinder 40. The clamping device 39 comprises two rigid plates 41 and 42 between which is arranged three hydraulic pistons 43 spaced at 120° to each other. The hydraulic pistons 43 are provided with gripping elements 44 for engaging with the tubular 7.

In use, the apparatus 1 is fitted to the rotor 2 of a top drive 3 via the rotor 5 of the apparatus 1. When it is desired to connect a stand of tubulars such as casing to a string of casing already lowered into a wellbore and suspended from a spider in the rig floor (not shown), the following steps are performed.

A stand of casing is moved from a storage area to the well centre, and is gripped by the pipe handling arm 12. The pipe handling arm 12, if necessary, moves the stand of casing to a position where the apparatus 1 may be lowered onto the top of the stand of casing. The apparatus 1 is lowered with the top drive 3 on the rails on the derrick of the rig. As the apparatus 1 is lowered, the circulating tool 30 inserts itself inside the stand of casing and the clamping device 39 passes over the box 45 of the casing 7.

The gripping elements 34 are moved radially outwardly by the hydraulic fluid pressure build up through feed passage 37 and into recess 35. The gripping elements 34 engage with the internal wall of the casing 7. It should be noted that the weight of the stand of casing may now be taken by the gripping elements 34. The pipe handling arm 12 can now move the stand of casing into exact alignment with the box of the casing string protruding above the spider in the rig floor. This step is necessary due to the stands of casing being slightly bent. As the stand of casing 7 moves, the circulating tool 30 moves with the casing 7. The pneumatic fluid in the inflatable ring 18 allows relative movement between the stationary top drive 3 and circulating tool and hence the casing 7. Once aligned, the stand of casing is lowered ("stabbed") into the box of the casing string by activation of piston and cylinders 15. Low torque rotation of the stand of casing now begins by rotation of the top drive rotor 2. It should be noted that the inflatable ring 18 helps accommodate non-linearity in the casing 7 since it allows the top of the casing 7 to float with respect to the longitudinal axis of the top drive 3 whilst being rotated to engage the pin of the casing 7 in the box of the casing string held in the spider in the rig floor. The low torque is transferred from the rotor 2 of the top drive through the piston and cylinders 15, through the housing 13 and via the inflatable ring 18 to the circulating tool 30 and hence to the stand of casing 7 via the gripping elements 34. The threaded pin of the stand of casing 7 is now partially made up with the threaded box of the casing string. The pipe handling arm 12 may now be removed from the casing 7 and swung into an inoperative position. The three piston and cylinders 43 of the clamping device are now activated evenly which moves the top of the stand of casing 7 and the circulating tool 30 into exact alignment with the top drive. The top drive may now be used to complete make-up by rotating the stand of casing typically up to 95,000 Nm (70,000 lb/ft) of torque. The high torque is transferred from the top drive 3 through piston and cylinders 15 through the housing 13, the rigid cylinder 40 and the clamping device 39 and hence to the stand of casing 7.

The spider may be used to hold the casing string 7 against rotation while this operation is carried out.

The elevator 8 may now be swung around the top of the casing 7. Circulation may now take place. Any pressure build up in the casing 7 would force the inflatable sealing ring 36 out and into engagement with the casing wall due to pressure build up through the feed passage 38. Circulating fluid may be pumped into the casing string through mud pipe 19, central bore 20 and central passage 32.

The spider may be released allowing the elevator 8 to take the weight of the casing string. The elevator 8 may lower the casing string into the wellbore. During lowering the top drive 3 may continue to rotate the apparatus 1 and hence rotate the casing string at up to 95,000 Nm (70,000 lbs/ft) of torque, if required. The apparatus 1 may be removed by deactivating the piston and cylinders 43 of the clamping device 39, the gripping elements 34 of the circulating tool 30, deflating the inflatable sealing ring 36 and lifting the apparatus 1 by raising the top drive 3.

A reverse sequence may be used to disconnect stands or single pieces of casing from a casing string.

It is envisaged that various modifications or variations may be made to the above described embodiment. In particular, the inflatable ring 18 may contain pneumatic fluid and be sealed. Alternatively, the inflatable ring 18 may be provided with a pneumatic supply line for controlling the pressure of the pneumatic fluid therein, for example for lowering the pressure when aligning the casing. The inflatable ring 19 may contain hydraulic fluid and be provided with a waste gate or a supply line for controlling the quantity of hydraulic fluid therein. A combination of both hydraulic and pneumatic fluids may be used preferably using hydraulic fluid in the inflatable ring and pneumatic bellows.

The inflatable ring may be a vehicle tyre.

It is envisaged that in certain embodiments the apparatus 1 may not be directly linked to the top drive 3. In particular, a motor, advantageously a hydraulic motor, may be inserted between the top drive 3 and the apparatus 1 for providing accurate speed of rotation and control for making up the casing.

It is envisaged that the apparatus 1 could be used for rotating the casing while lowering the casing. Reciprocation of the casing may also be provided simultaneously by raising and lowering the elevator.

It is envisaged that the casing string may be provided with a drilling bit as its lower end. The apparatus 1 may be used, with the clamping device 39 actuated, to rotate the casing and hence the drill bit, for drilling a wellbore.

It is conceivable that the clamping device 39 could be dispensed with and the entire torque from the top drive transmitted through the inflatable ring 18, particularly if highly pressurized with hydraulic fluid at the time it is desired to transmit high torque.

It is also envisaged that any suitable mechanism and method of actuation could be used for external clamping. For example, the mechanism could comprise cam surfaces with rough material thereon. The method of actuation could be mechanical, electrical, pneumatic, hydraulic or chemical. A design from a power tong may be suitable for this purpose.

While the foregoing is directed to embodiments of the present invention, other and further embodiments of the invention may be devised without departing from the basic scope thereof, and the scope thereof is determined by the claims that follow.

What is claimed is:

1. A clamping apparatus for use with a top drive for gripping and turning a drill string formed of pipe, the clamping apparatus comprising:

gripping members positioned to grip and support the pipe;

a drive member for moving the gripping members radially inwardly into a pipe gripping position and radially outwardly to a pipe releasing position; and an attachment member for connecting the clamping apparatus to the top drive for wellbore drilling, wherein the clamping apparatus is rotatable by the top drive.

2. The clamping apparatus of claim 1, wherein the drive member includes a hydraulic system.

3. The clamping apparatus of claim 1, further comprising a stabbing spear extending out between the gripping members and formed to fit within the pipe to be gripped by the clamping apparatus.

4. The clamping apparatus of claim 3, wherein the stabbing spear includes a drilling fluid conduit for conducting a flow of drilling fluid from the top drive.

5. The clamping apparatus of claim 3, wherein the stabbing spear includes a seal adapted to seal between the stabbing spear and the pipe to be gripped.

6. The clamping apparatus of claim 1, further comprising a drilling fluid conduit for conducting a flow of drilling fluid from the top drive.

7. The clamping apparatus of claim 1, wherein the pipe comprises casing.

8. The clamping apparatus of claim 7, wherein the drive member includes a hydraulic system.

9. The clamping apparatus of claim 7, further comprising a stabbing spear extending out between the gripping members and formed to fit within the pipe to be gripped by the clamping apparatus.

10. The clamping apparatus of claim 1, wherein the gripping members are adapted to transfer torque to the pipe.

11. A gripping apparatus for use in connection with a top drive assembly, comprising:

a housing defining a central passageway sized for receipt of a tubular, the housing being coupled to the top drive assembly for rotation therewith;

a plurality of gripping elements disposed within the housing and displaceable between disengaged and engaged positions; and a powered system adapted to selectively drive the plurality of gripping members between the disengaged and engaged positions.

12. The gripping apparatus of claim 11, wherein the powered system comprises a hydraulic system.

13. The gripping apparatus of claim 11, wherein the plurality of gripping members are moved radially when displaced between the disengaged and engaged positions.

14. The gripping apparatus of claim 11, wherein the tubular comprises casing.

15. The gripping apparatus of claim 14, wherein the plurality of gripping members are moved radially when displaced between the disengaged and engaged positions.

16. The gripping apparatus of claim 11, wherein the housing is coupled to a drive shaft of the top drive assembly.

17. The gripping apparatus of claim 11, wherein the plurality of gripping members are adapted to engage an exterior portion of the tubular.

18. A clamping apparatus for use with a top drive for gripping and turning a drill string formed of pipe, the clamping apparatus comprising:

gripping members positioned to grip and support the pipe;

a drive member for moving the gripping members radially inwardly into a pipe gripping position and radially outwardly to a pipe releasing position;

an attachment member for connecting the clamping apparatus to the top drive for wellbore drilling; and a stabbing spear extending out between the gripping members and formed to fit within the pipe to be gripped by the clamping apparatus.

19. The clamping apparatus of claim 18, wherein the stabbing spear includes a drilling fluid conduit for conducting a flow of drilling fluid from the top drive.

20. The clamping apparatus of claim 18, wherein the stabbing spear includes a seal adapted to seal between the stabbing spear and the pipe to be gripped.

21. The clamping apparatus of claim 18, wherein the drive member includes a hydraulic system.

22. The clamping apparatus of claim 18, wherein the gripping members are adapted to transfer torque to the pipe.

23. A clamping apparatus for use with a top drive for gripping and turning a drill string formed of casing, the clamping apparatus comprising:

gripping members positioned to grip and support the casing;

a drive member for moving the gripping members radially inwardly into a casing gripping position and radially outwardly to a casing releasing position;

an attachment member for connecting the clamping apparatus to the top drive for wellbore drilling; and a stabbing spear extending out between the gripping members and formed to fit within the casing to be gripped by the clamping apparatus.

24. The clamping apparatus of claim 23, wherein the stabbing spear includes a drilling fluid conduit for conducting a flow of drilling fluid from the top drive.

25. The clamping apparatus of claim 23, wherein the stabbing spear includes a seal adapted to seal between the stabbing spear and the casing to be gripped.

26. The clamping apparatus of claim 23, further comprising a drilling fluid conduit for conducting a flow of drilling fluid from the top drive.

27. The clamping apparatus of claim 23, wherein the drive member includes a hydraulic system.

28. The clamping apparatus of claim 23, wherein the gripping members are adapted to transfer torque to the casing.

29. A method for gripping and turning a tubular using a top drive, comprising:

coupling a gripping apparatus to the top drive, the gripping apparatus having radially movable gripping elements adapted to engage the tubular;

actuating the gripping elements to engage the tubular;

inserting a fluid conduit into the tubular; and rotating the top drive, thereby rotating the tubular.

30. The method of claim 29, wherein actuating the gripping elements comprises moving the gripping elements radially.

31. The method of claim 30, wherein the gripping elements are actuated using a hydraulic fluid.

32. The method of claim 30, further comprising transferring torque to the tubular.

33. The method of claim 29, wherein the gripping elements are actuated using a hydraulic fluid.

34. The method of claim 29, further comprising transferring torque to the tubular.

35. The method of claim 29, wherein the fluid conduit comprises a gripping tool.

36. The method of claim 29, wherein the tubular comprises casing.

37. A clamping apparatus for use with a top drive for gripping and turning a drill string formed of casing, the clamping apparatus comprising:

gripping members positioned to grip and support the casing;

a drive member for moving the gripping members radially inwardly into a casing gripping position and radially outwardly to a casing releasing position;

an attachment member for connecting the clamping apparatus to the top drive for wellbore drilling; and a drilling fluid conduit for conducting a flow of drilling fluid from the top drive.

38. A clamping apparatus for use with a top drive for gripping and turning a drill string formed of casing, the clamping apparatus comprising:

gripping members positioned to grip and support the casing;

a drive member for moving the gripping members radially inwardly into a casing gripping position and radially outwardly to a casing releasing position; and an attachment member for connecting the clamping apparatus to the top drive for wellbore drilling, wherein the drive member includes a hydraulic system.

* * * * *

US007004259C1

(12) INTER PARTES REEXAMINATION CERTIFICATE (0352nd)

United States Patent

Pietras

(10) Number: US 7,004,259 C1

(45) Certificate Issued: Mar. 6, 2012

(54) APPARATUS AND METHOD FOR FACILITATING THE CONNECTION OF TUBULARS USING A TOP DRIVE

(75) Inventor: Bernd-Georg Pietras, Wedemark (DE)

(73) Assignee: Weatherford Lamb, Inc., Houston, TX (US)

Reexamination Request:
No. 95/001,115, Nov. 18, 2008

Reexamination Certificate for:

| | |
|---|---|
| Patent No.: | **7,004,259** |
| Issued: | **Feb. 28, 2006** |
| Appl. No.: | **10/621,971** |
| Filed: | **Jul. 17, 2003** |

Related U.S. Application Data

(63) Continuation of application No. 09/868,438, filed as application No. PCT/GB99/03944 on Nov. 29, 1999, now Pat. No. 6,622,796.

(30) Foreign Application Priority Data

Dec. 24, 1998 (GB) ..... 9828669

(51) Int. Cl.
*E21B 19/00* (2006.01)

(52) U.S. Cl. ..... 166/379; 166/77.51; 166/85.1; 175/170

(58) Field of Classification Search ..... None
See application file for complete search history.

(56) References Cited

To view the complete listing of prior art documents cited during the proceeding for Reexamination Control Number 95/001,115, please refer to the USPTO's public Patent Application Information Retrieval (PAIR) system under the Display References tab.

*Primary Examiner*—Peter C. English

(57) ABSTRACT

An apparatus for facilitating the connection of tubulars using a top drive, the apparatus comprising a supporting member (13) connectable to said top drive (3) characterized in that it further comprises an internal tool (30) for engaging said tubular (7) and an external clamping device (39) for engaging said tubular (7).

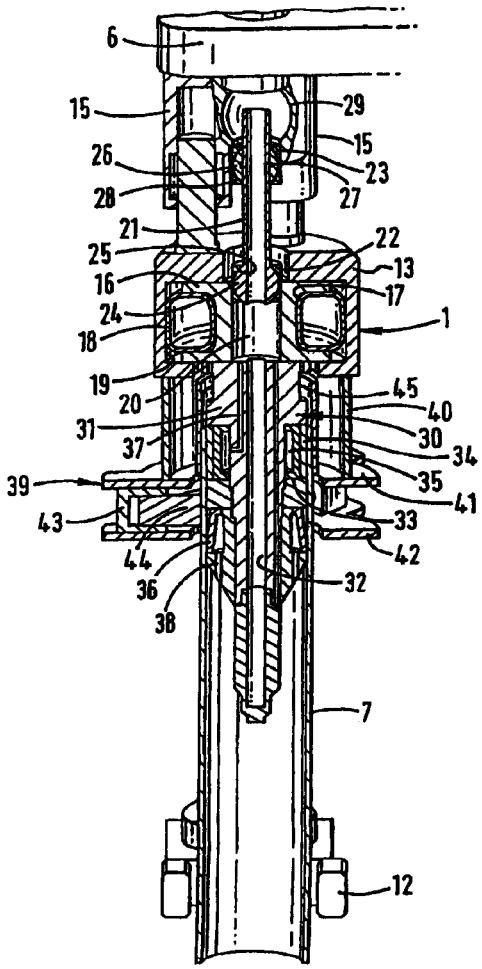

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-38 are cancelled.

* * * * *